US012116190B2

(12) United States Patent
Runge et al.

(10) Patent No.: US 12,116,190 B2
(45) Date of Patent: Oct. 15, 2024

(54) DEVICES FOR PRE-WETTING WIPES AT POINT OF USE AND METHODS OF USE

(71) Applicant: PEER INNOVATIONS, LLC, Gainesville, FL (US)

(72) Inventors: Pamela Runge, Gainesville, FL (US); Nicholas Ransom Powley, Saint Paul, MN (US)

(73) Assignee: P2P CONNECT, LLC, Gainesville, FL (US)

( * ) Notice: Subject to any disclaimer, the term of this patent is extended or adjusted under 35 U.S.C. 154(b) by 41 days.

(21) Appl. No.: 17/365,998

(22) Filed: Jul. 1, 2021

(65) Prior Publication Data

US 2022/0002046 A1 Jan. 6, 2022

Related U.S. Application Data

(60) Provisional application No. 63/046,695, filed on Jul. 1, 2020.

(51) Int. Cl.
*B65D 51/28* (2006.01)
*A47K 10/32* (2006.01)
(Continued)

(52) U.S. Cl.
CPC ..... *B65D 51/2857* (2013.01); *A47K 10/34* (2013.01); *A47K 10/421* (2013.01);
(Continued)

(58) Field of Classification Search
CPC ..... B65D 51/2857; B65D 51/2807; B65D 51/28; B65D 83/0805; B65D 2583/082;
(Continued)

(56) References Cited

U.S. PATENT DOCUMENTS 5,542,567 A * 8/1996 Julius ..... B65D 83/0805 221/63
2003/0159403 A1* 8/2003 Verespej ..... B65D 83/0805 53/471

(Continued)

FOREIGN PATENT DOCUMENTS

EP 3581515 A1 * 12/2019 ..... B65D 75/008
GB 2538235 A * 11/2016 ..... A47K 10/32
WO WO-2012028977 A2 * 3/2012 ..... B65D 43/164

*Primary Examiner* — Rafael A Ortiz

(74) *Attorney, Agent, or Firm* — Maxwell L. Minch; Maxwell L Minch Esq. PA

(57) ABSTRACT

The present invention generally provides a towel wetting or pre-wetting device for the wetting of towels at the point of use. More specifically, the present invention provides for disposable towel pre-wetting devices which provide a point of use wetting for cleaning and disinfecting wipes or towels. Embodiments allow for activation of the towel pre-wetting device with a towel through the lid which temporarily unseals the bowl from the cap allowing fluid to be released from the reservoir to pre-wet a towel as it is extracted through the lid. Embodiments allow for the adjustment of the bowl relative to the cap which controls the volume of fluid to be released to wet the towel. The pre-wetting device is intended to be affixed to the top of a cylinder of towels. Thus the present invention solves the unmet need of providing for wet cleaning wipes or towels at the point of use.

22 Claims, 12 Drawing Sheets

(51) Int. Cl.
*A47K 10/34* (2006.01)
*A47K 10/42* (2006.01)
*B65D 83/08* (2006.01)

(52) U.S. Cl.
CPC .. *B65D 83/0805* (2013.01); *A47K 2010/3273* (2013.01); *B65D 2583/082* (2013.01)

(58) Field of Classification Search
CPC ..... A47K 10/34; A47K 10/421; A47K 2010/3266; A47K 2010/3273
USPC ..... 206/205, 229, 233; 221/191, 192–194, 221/312 C, 309
See application file for complete search history.

(56) References Cited

U.S. PATENT DOCUMENTS

2015/0272405 A1* 10/2015 Powling ..... A47K 10/421 221/63
2015/0272406 A1* 10/2015 Hill ..... A47K 10/421 221/48
2017/0129660 A1* 5/2017 Hsu ..... B65D 51/18

* cited by examiner

FIG 3D
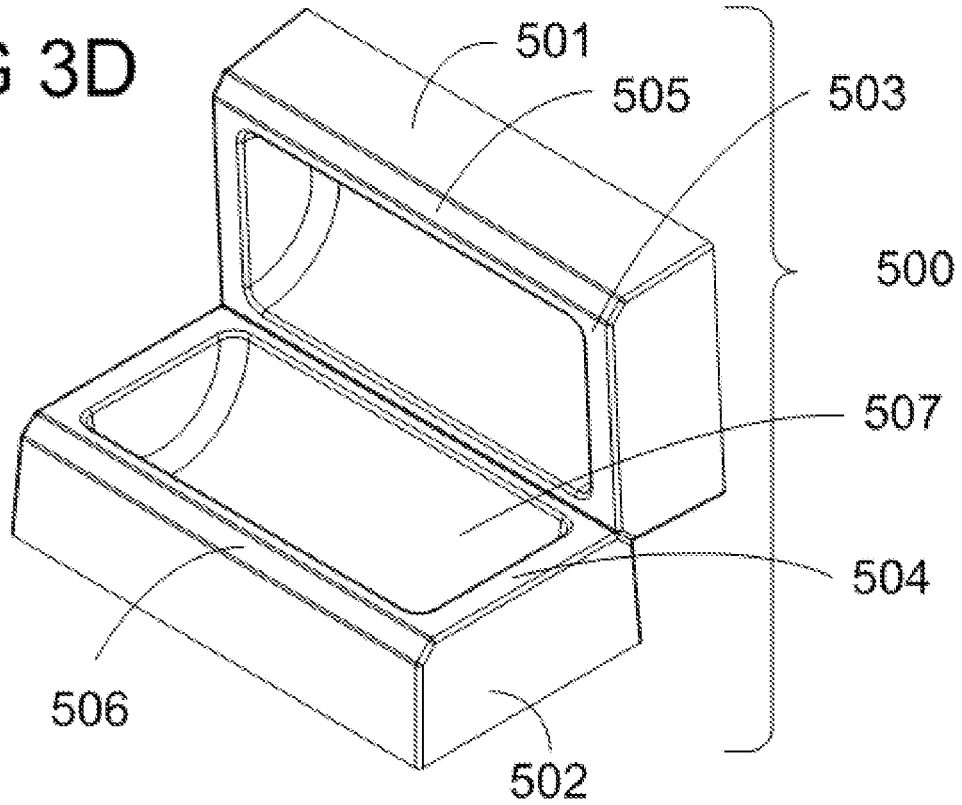
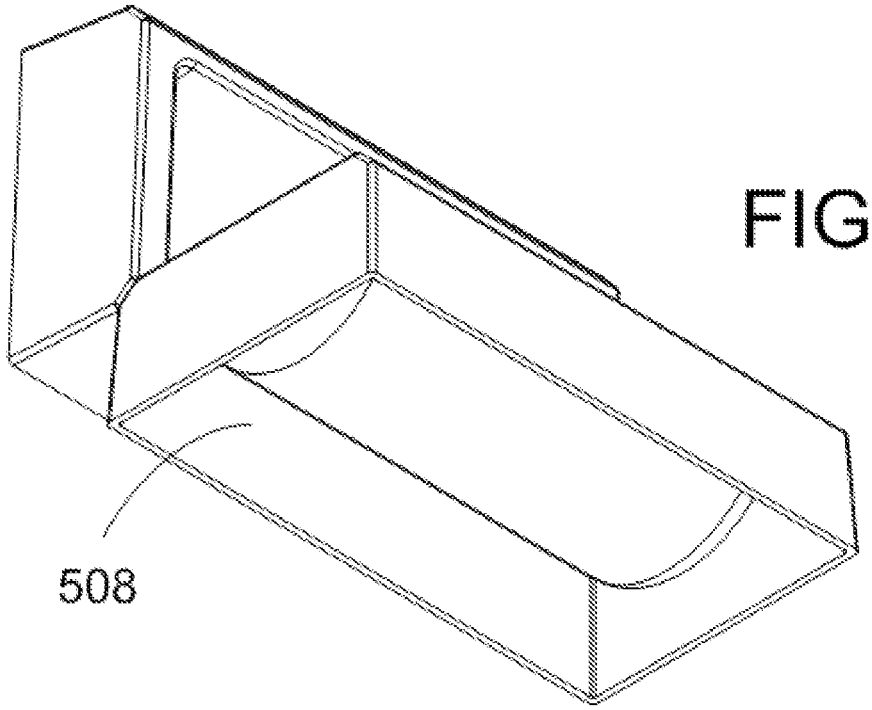
FIG 3E

DEVICES FOR PRE-WETTING WIPES AT POINT OF USE AND METHODS OF USE

CROSS-REFERENCES TO RELATED APPLICATION

This invention claims priority to U.S. Provisional Application for Patent No. 63/046,695, which was filed on Jul. 1, 2020, the entirety of which is incorporated herein by reference.

FIELD OF INVENTION

The present invention is in the technical field of disposable towel wetting or pre-wetting devices. More particularly, the present invention is in the technical field of towel wetting or pre-wetting devices for the wetting of towels at the point of use.

BACKGROUND

One of the major problems facing the healthcare system, along with additional markets including retail and industrial markets, is the difficulty in stopping the spread of infection from one person to another. This problem is ubiquitous and many individual consumers are highly interested in limiting their exposure to dangerous microbes at home, in the workplace and at points of care. For the healthcare industry, however, the problem has reached staggering proportions. In 2009, the U.S. Centers for Disease Control published the results of a study on the direct hospital cost of treating healthcare-associated infections ("HAIs"). In 2017, The Leapfrog Group reported a US HAI study revealed 2 million hospital patients will contract a HAI and 90,000 of those will die each year. The U.S. Centers for Disease Control (CDC) estimates on any given day 1 in 25 hospital patients has a HAI complication and is considered the 4th leading cause of death in the US.

HAIs can have devastating effects on physical, mental/emotional and financial health. They cost billions of dollars in added expenses to the healthcare system. In 2009, the CDC published the results of a study on the direct hospital cost of treating HAIs that showed that after adjusting for inflation, "the overall annual direct costs of HAI to U.S. hospitals ranges from $28.4 to $33.8 billion (after adjusting to 2007 dollars using the [Consumer Price Index] for all urban consumers) and $35.7 billion to $45 billion (after adjusting to 2007 dollars using the [Consumer Price Index] for inpatient hospital services)." That same study found that benefits of preventing such infections ranged from $5.7 billion to $31.5 billion.

Given this disturbing trend, the importance of delivering quality care is even more essential as hospitals and health systems face increased pressure to reduce and prevent HAIs from government agencies to end users/consumers. With the emergence of the coronavirus, heightened consumer awareness has alerted them to take preventive steps to protect their own health. They have been reminded of the benefits of frequent hand hygiene and wearing personal protection equipment ("PPEs"/i.e., masks) to help stop the spread of disease. Cleaning and disinfectant supplies have rapidly become highly prized for keeping environments and surfaces decontaminated. Not unlike hospital system protocols for reducing the spread of infection, the challenge for any user/consumer lies within choosing which products are most effective for addressing the need and assuring users follow manufacturers labeling instructions correctly to achieve the desired outcome. If either of these key areas is overlooked, directly or indirectly, the likelihood of reducing or eliminating microbes becomes compromised. As it relates to prepared or pre-wet disinfecting wipes (ready-to-use, "RTU"), by law wipes must be saturated with an appropriate EPA registered disinfectant germicide and the solution allowed to remain wet on the surface for the manufacturers recommended minimum contact time to kill microorganisms.

Two of the biggest related challenges in the use of pre-wet disposable wipes, for a variety of reasons, is the towels tend to dry out over time in the dispenser and when applied, the surface does not remain wet for the required contact kill times. As a result, the product efficacy at the "point of usage" comes into question, even with using an EPA approved solution that was applied to wipes at the time of manufacture; when it comes time to apply the wipe to a surface, a user may not knowingly have a wet enough wipe. The best intentions may not achieve the desired outcome with a compromised product at the time of use if not applied correctly and effectively. Furthermore, because the law demands following duration of exposure, if a user selects exposure conditions that are different than the EPA regulated label, the user assumes all liability for any injury resulting from off-label use and is potentially subject to enforcement under the Federal Insecticide, Fungicide and Rodenticide Act (FIFRA). In addition to user error, cross-contamination results from time constraints in healthcare settings, adding to the challenge of adherence to required EPA disinfectant guidelines and remains a threat to the spread of infection. To address these challenges, disinfectant wipe manufacturers have continued to improve their formulas to shorten the exposure time required, from 10 minutes down to 3 or 1 minute. However, the problem still exists, mostly due to user error or the like, which is not being addressed with formula enhancements or existing packaging. A novel point of use wetting system directly addresses the critical issues by providing assurance of a fully wet saturated wipe or towel when being used for increased confidence, efficiency, efficacy and improved outcomes. This novel invention is not limited to healthcare but has wide application into a variety of wipes and industries, from retail to industrial as examples.

Although many infections and nosocomial infections are technically preventable, one limitation on the healthcare or other industry's ability to fight them is the inadequacy of the current state of sanitary wipes or towels and their dispensers. As our understanding of microbes and infectious diseases grows, scientists have tried to provide increasingly effective antiseptic germicide solutions to clean and disinfecting surfaces, instruments, and patient's skin.

Often, pre-wetted wipes are used to transfer and apply solutions to the objects needing to be cleaned and/or disinfected. One limitation that many such solutions have is that, to be effective, the fluids used must be present in sufficient quantities to either carry the dissolved antiseptic components to the site of the microbes, or to attack the microbes themselves—e.g., with solutions using alcohol to disinfect surfaces. Unfortunately, often the solutions most effective at killing microbes have high vapor pressures and evaporate quickly. With such highly evaporative solutions, through either time or when users accidentally leave the cap to towelette dispensers open towelettes often dry out wasting money and exposing patients and facilities to cross-contamination risks. When the fluid or solution level and the active components of such solutions, which are often correlated, are diminished, any towel or wipe that has been treated with the solution loses much, if not all, of its effectiveness at killing microbes. The ability of a pre-wet disinfectant wipe to effectively sanitize or kill microbes is correlated to the amount of solution dispensed with the wipe and applicable to the surface. Many disinfecting wipe dispensers specify the duration of time the disinfecting solution must be present, in liquid form, on the surface to be sanitized. Dryer wipes often do not dispense enough liquid to surfaces to be sanitized to meet such specified kill durations. Because manufacturers recognize the market potential for providing an effective way of dispensing adequately moistened towels, much time and energy has been spent trying to meet this demand.

Currently, manufacturers address the moistening or wetting problem one of two ways: first, by providing towelette containers into which an antiseptic solution has been poured or sprayed on wipes in large quantities to fully saturate the wipes (i.e., "pre-moistened"); and second, by adding a tamper evident plastic safety seal on the wipes container to avoid the liquid from spilling or evaporating prior to opening. Both attempts have serious drawbacks in terms of product efficacy: first, during transit and storage, the solution usually ends up pooling at the bottom of the upright container, leaving an uneven distribution of liquid on wipes. Second, once the safety seal is removed and discarded, it cannot address ongoing liquid evaporation challenges mainly caused by environmental exposure, such as the user error of leaving the lid open thereby accelerating solution evaporation and adding to the problem of ineffective dry wipes.

Thus there exists an unmet need to the above-stated problems by providing point-of-use wetting for cleaning and disinfecting wipes, towels, towelettes, and the like.

SUMMARY OF THE INVENTION

The present invention provides for disposable towel pre-wetting devices which provide a point of use wetting for cleaning and disinfecting wipes, towels, towelettes, and the like.

In one aspect of the invention, a towel pre-wetting device is defined by a lid and a bowl combined to form a reservoir. Activation of the towel pre-wetting device with a towel through the lid temporarily unseals the bowl from the cap allowing fluid to be released from the reservoir to pre-wet a towel as it is extracted through the lid. Embodiments allow for the adjustment of the bowl relative to the cap which controls the volume of fluid to be released to wet the towel. The pre-wetting device is intended to be affixed to the top of a cylinder of towels.

In one aspect of the invention, the reservoir is pre-filled or filled with solution as needed.

Other aspects of the invention provide for self-contained towel pre-wetting devices where towels and fluid are in a common container and towels are wet by being pulled through a volume of wetting fluid as they are extracted from the device.

This summary is provided to introduce a selection of concepts in a simplified form that are further described below in the Detailed Description. The foregoing has outlined some of the pertinent objects of the invention. These objects should be construed to be merely illustrative of some of the more prominent features and applications of the intended invention. Many other beneficial results can be attained by applying the disclosed invention in a different manner or modifying the invention within the scope of the disclosure. Accordingly, other objects and a fuller understanding of the invention may be had by referring to the summary of the invention and the detailed description of the preferred embodiment in addition to the scope of the invention defined by the claims taken in conjunction with the accompanying drawings.

BRIEF DESCRIPTION OF THE DRAWINGS

Examples illustrative of embodiments of the disclosure are described below with reference to figures attached hereto. In the figures, identical structures, elements or parts that appear in more than one figure are generally labeled with the same numeral in all the figures in which they appear. Dimensions of components and features shown in the figures are generally chosen for convenience and clarity of presentation and are not necessarily shown to scale. Many of the figures presented are in the form of schematic illustrations and, as such, certain elements may be drawn as simplified or not-to-scale, for illustrative clarity. The figures are not intended to be production drawings. The figures (Figs.) are listed below.

FIG. 3D is an elevated oblique view of two components assembled into a pre-wetting device 500 shown in the open condition.

FIG. 3E is a lower oblique view of two components assembled into a pre-wetting device 500 shown in the open condition.

Figure 1A:
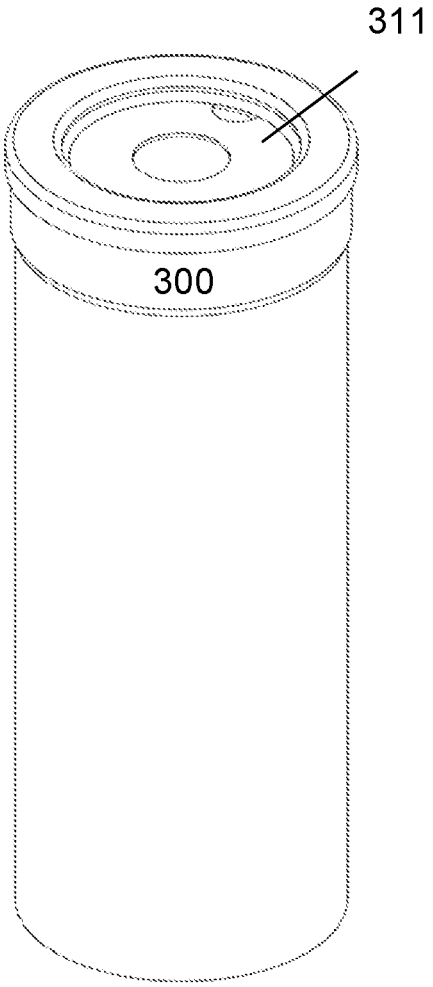
FIG. 1A provides an oblique view of one closed embodiment of an inventive towel pre-wetting device 300.
Figure 1B:
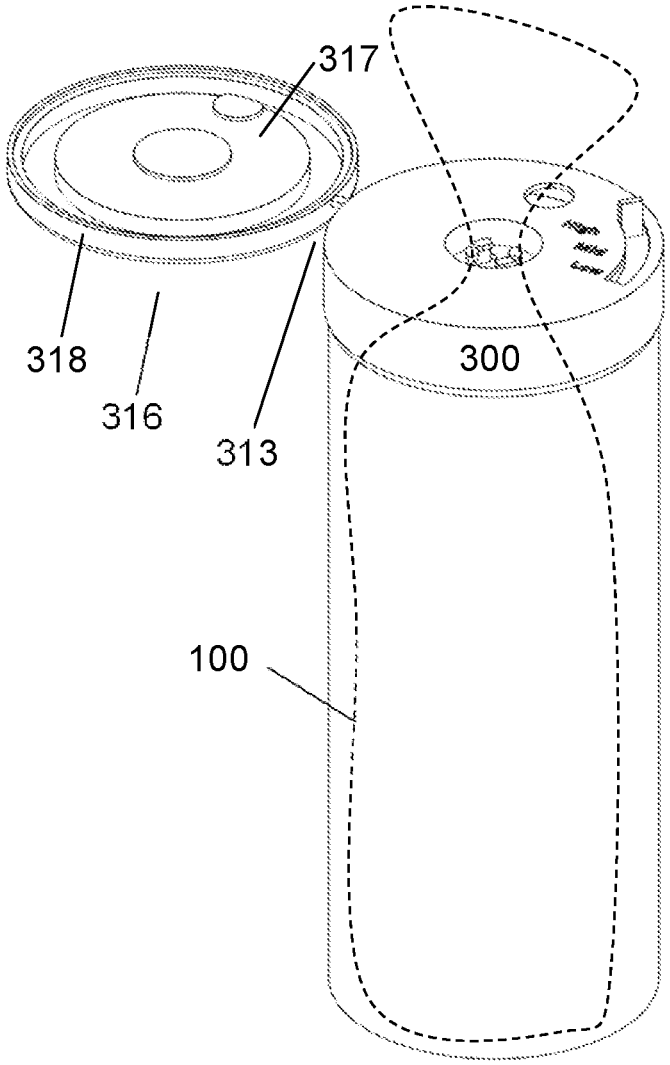
FIG. 1B provides an oblique view of one open embodiment of an inventive towel pre-wetting device 300.
Figure 1C:
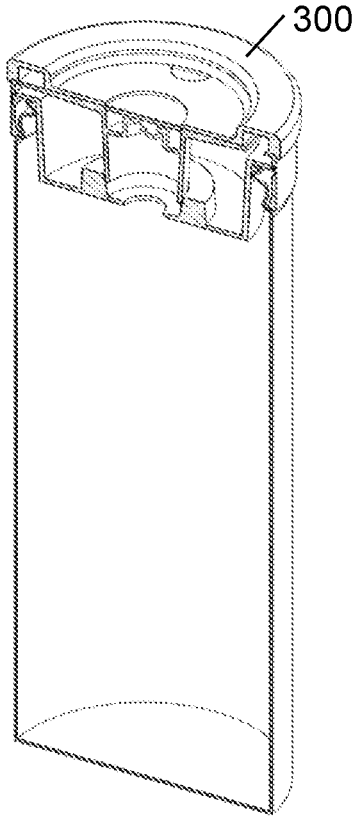
FIG. 1C provides an oblique cutaway view of one closed embodiment of an inventive towel pre-wetting device 300.
Figure 1D:
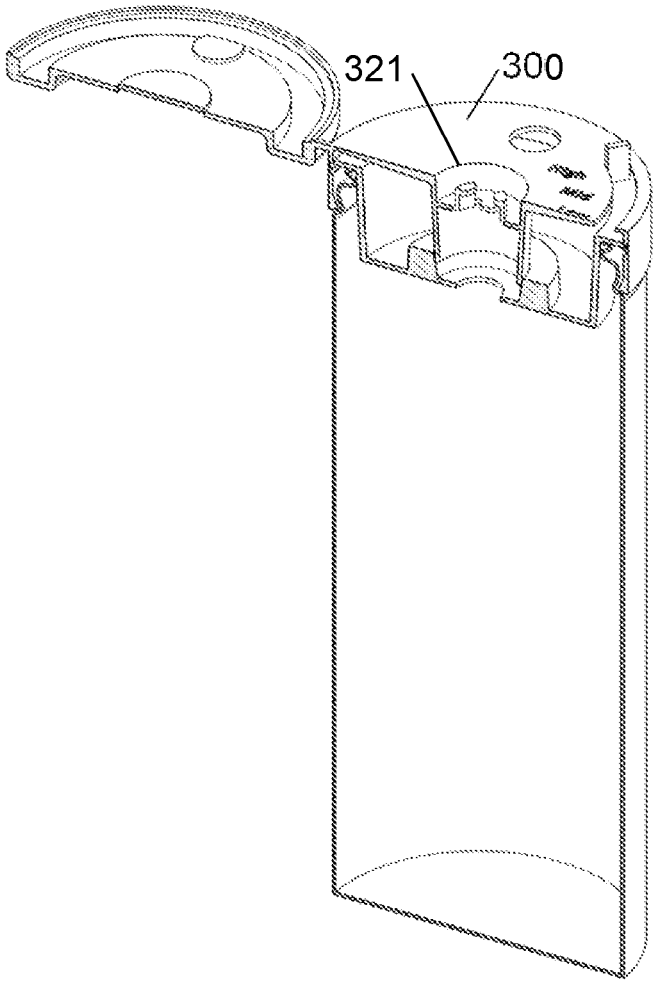
FIG. 1D provides an oblique cutaway view of one open embodiment of an inventive towel pre-wetting device 300 a towel void 321.
Figure 1E:
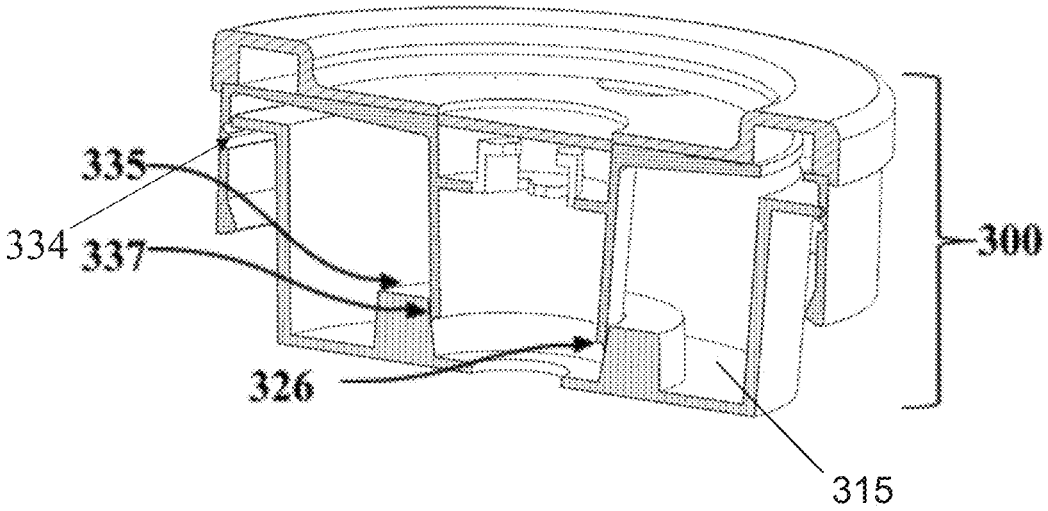
FIG. 1E is an oblique cutaway view of an embodiment of a towel pre-wetting device 300 illustrating a dam 335, a sealing interference 337, a rib 326, and a reservoir 315.
Figure 1F:
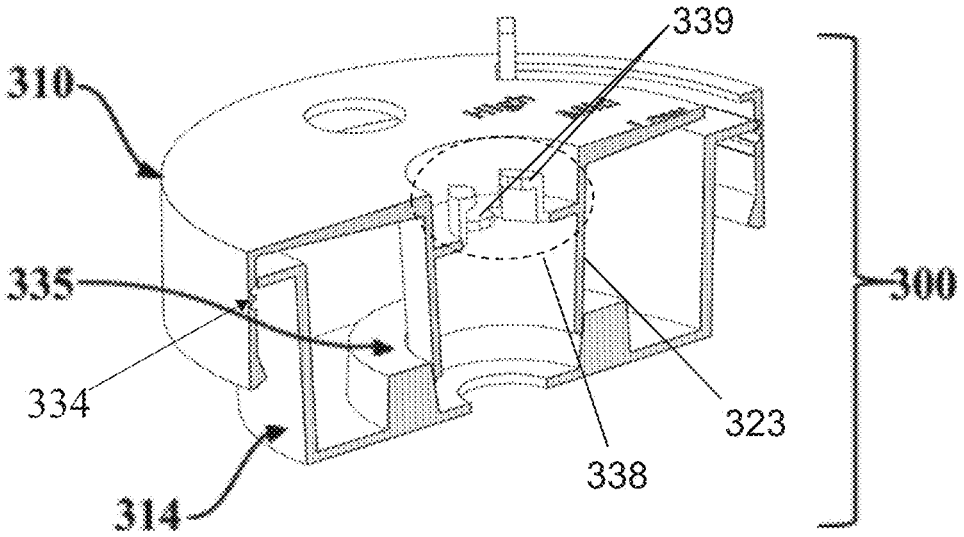
FIG. 1F provides a second oblique cutaway view of one embodiment of an inventive towel pre-wetting device 300 illustrating the lid 310, a dam 335, an inner bowl 314, towel retaining levers 339, a towel retainer 338, and a void wall 323.
Figure 1G:
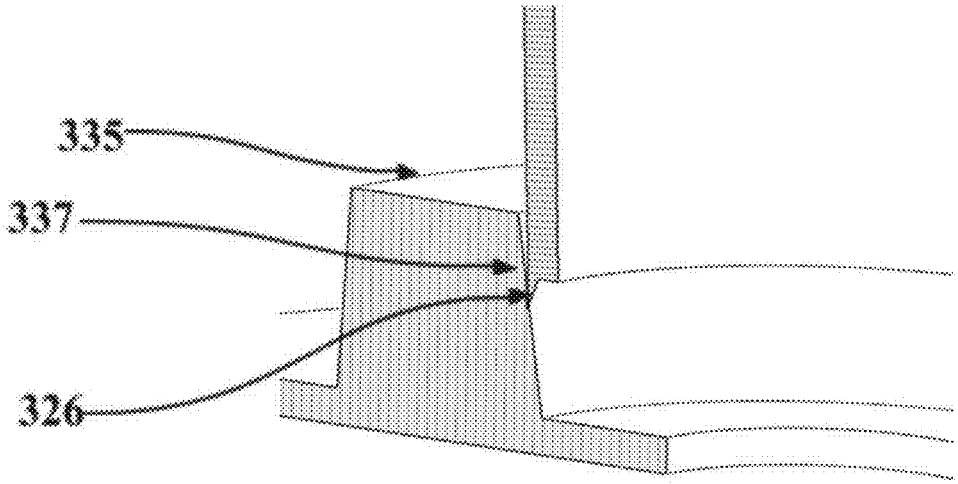
FIG. 1G is an enlarged cutaway view of an embodiment of a towel pre-wetting device 300 illustrating a dam 335, a sealing interference 337, and a rib 326.
Figure 1H:
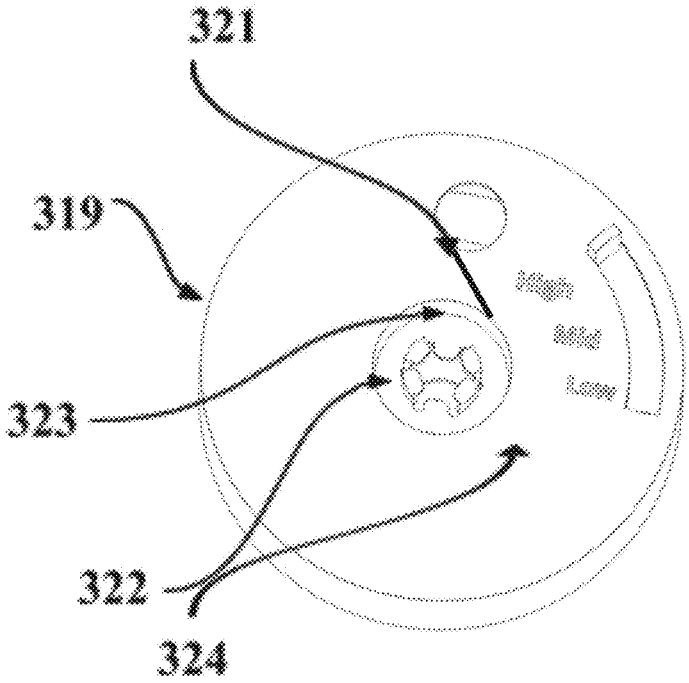
FIG. 1H provides a perspective top view of one embodiment of an inventive towel pre-wetting device 300 illustrating a towel outlet tube 323, a top surface 322, a towel void 321, a patterned interruption 324, and a lid surface 319.
Figure 1I:
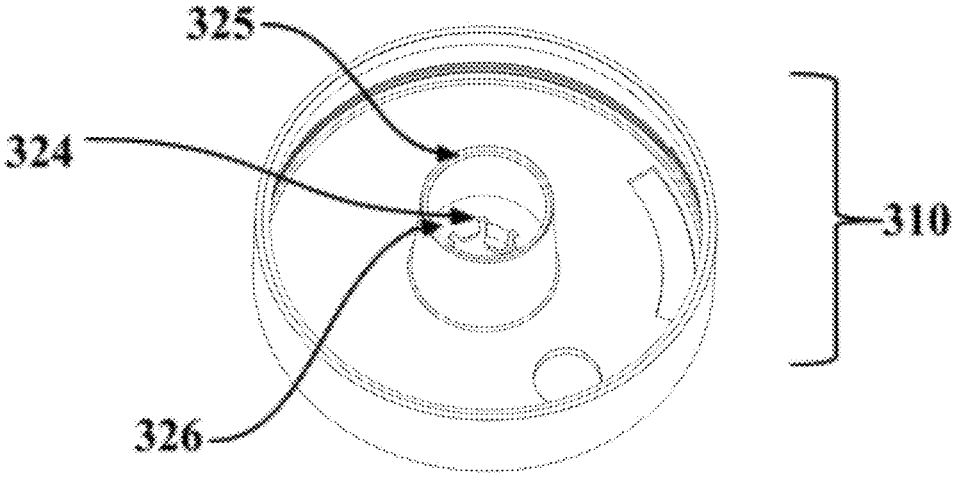
FIG. 1I is a perspective view of the underside of the lid 310 of an embodiment of a towel pre-wetting device 300 illustrating a patterned interruption 324, a bottom surface 325, and a rib 326.
Figure 1J:
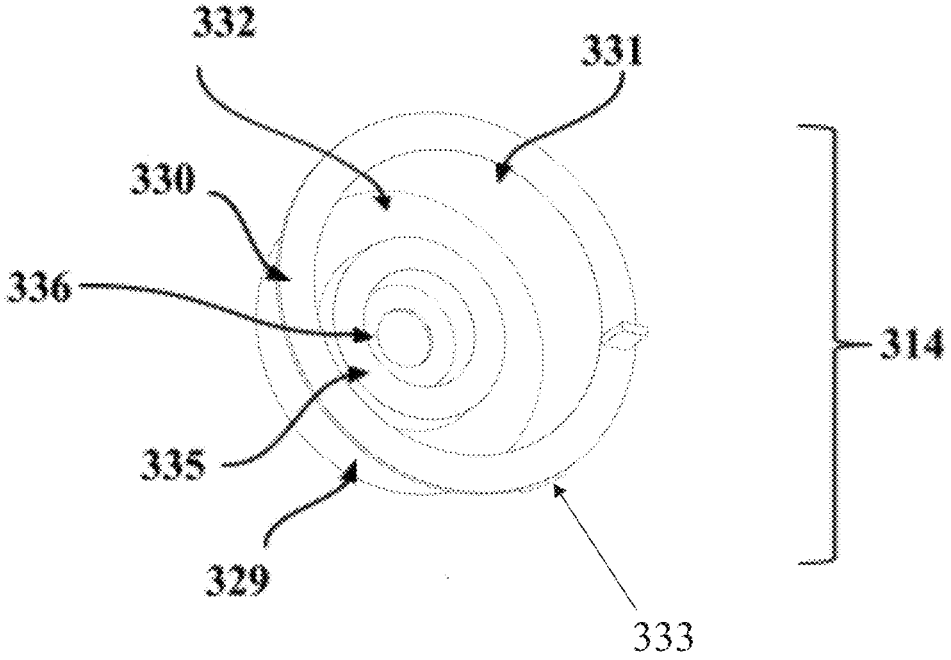
FIG. 1J is a perspective view of the topside of the inner bowl 314 of an embodiment of a towel pre-wetting device 300, illustrating an outer surface 329, a lip 330, an inner wall 331, an inner surface bottom 332, a dam 335, and a towel inlet 336.

It should be clear that the description of the embodiments and attached Figures set forth in this specification serves only for a better understanding of the invention, without limiting its scope. It should also be clear that a person skilled in the art, after reading the present specification could make adjustments or amendments to the attached Figures and above described embodiments that would still be covered by the present invention.

DETAILED DESCRIPTION

The present invention is directed towards devices for wetting disposable towels at the point of use. More specifically, the present invention is directed towards devices and use cases where the pre-wetting of towels too far in advance may cause the dehydration or deactivation of active ingredients or chemicals over time. More specifically, the present invention is necessary where a liquid or solution based chemical is applied to a pre-wetted towel for use in a medical or laboratory setting.

The following detailed description is exemplary in nature and is in no way intended to limit the scope of the invention, its application, or uses, which may vary. The invention is described with relation to the non-limiting definitions and terminology included herein. These definitions and terminology are not designed to function as a limitation on the scope or practice of the invention, but are presented for illustrative and descriptive purposes only.

The object of the present invention is to provide pre-wetting devices that provide point-of-use wetting solutions for wipes, towels, towelettes, or the like.

In one embodiment of the invention, a towel or towelette pre-wetting device is defined by an upper (lid) and a lower (bowl) that together form a reservoir. In this embodiment, activation occurs as a towelette is drawn through the upper, temporarily unsealing the upper from the lower and allowing fluid or solution to be released from the reservoir onto and or into the pre-wet or dry towel or towelette as it is extracted through the upper. Upon removal of the towelette from the upper, the force applied by the user is released, causing the upper and the lower to reseal the reservoir, preventing the flow of fluid from the reservoir into additional towels. Variations of this embodiment allow for the adjustment of the preloaded interference force between the upper and the lower in order to control the volume of fluid to be released to wet the towel when a towel or towelette is extracted. Generally, the pre-wetting device of this embodiment is intended to be affixed to the top of a cylindrical vessel containing towels or towelettes. Optionally, the pre-wetting device of this embodiment may store towels or towelettes in a dry condition and wet them only as they are withdrawn from the pre-wetting device at the point-of-use.

Other pre-wetting embodiments of this invention provide towel pre-wetting devices where towels and fluids or solutions are in a common container and towels are wet by being stored in, or fed through, a volume of wetting fluid as they are extracted from the device.

It is to be understood that in instances where a range of values are provided that correlate to the wetness of the towel or towelette to be dispensed, the range is intended to encompass not only the end point values of the range including but not limited to on or off entirely, but also intermediate values of the range to be explicitly included within the range and varied by the last significant figure of the range. By way of example, a recited range of from 1 to 4 is intended to include 1-2, 1-3, 2-4, 3-4, and 1-4. Low to high or medium to high are other recited ranges. Such ranges can help the dispenser account for the viscosity of the fluid to be dispensed.

As used herein "wipes" or "towels" shall mean any woven or non-woven paper towel, tissue, cleaning and disinfecting wipe, towels, towelettes, wipes and the like.

As used herein "disposable wipes" shall mean single use disposable, semi-disposable or reusable, wipes may be dry, pre-wet or RTU.

As used herein "disinfecting wipes" shall mean any wipe that is prepared with a solution used for single or multi-purpose, such as cleaning, disinfecting, sanitizing, and the like.

As used herein "point-of-use" shall mean at the time the towel is pulled or withdrawn from a towel-holding container or dispenser for use.

Generally

The present invention provides a cap for wetting towels at the point-of-use. In at least one embodiment, the cap has at least a fluid holding portion and a towel wetting portion. The fluid holding portion will contain an antiseptic fluid, the makeup of which is not a subject of this invention, which wets the towels as they are pulled through the towel wetting portion so the towels may be effective for their disinfecting purpose.

The present invention further provides for configuring a cap to a towel holder. It is appreciated that many towel holders exist, and it is thus understood that the cap, while retaining its functional features, can be made in several sizes and shapes in order to be compatible with towel holders being used in a desired industry. In at least one embodiment the cap is an after-market replacement for existing caps of pre-wetted or dry towels. In other embodiments, the cap is used by a manufacturer and fitted custom to a manufacturer's towel container. In certain embodiments, the cap is further provided with a fastening mechanism that allows the cap to attach to a container for holding dry or pre-moistened towels. Many methods are known in the art for fastening caps to containers, and nothing herein should be considered to limit the available techniques or methods for fastening a cap to a container. In at least one embodiment the cap is threaded to the towel container. In another embodiment, the cap is secured to the towel container through the use of a ridge or valley, or a series of ridges or valleys which affixes the cap to the towel container.

Lid and Bowl

A fluid holding portion is intended to hold the desired wetting fluid for the dry towels to be applied at the point of use. It is intended that the fluid holding portion only release fluids upon demand to the towels which may be dry or slightly pre-wetted with the desired chemical or some other fluid, such as water. In at least one embodiment, the fluid holding portion is a fluid reservoir disposed within the cap. In at least one embodiment, the fluid reservoir surrounds the towel wetting portion.

In at least one embodiment of the present invention, a disposable towel pre-wetting device 300 is comprised of a lid 310 and further a separate inner bowl 314 such that the lid 310 and the inner bowl 314 are configured to form a reservoir 315. The towel pre-wetting device 300 is intended to be affixed over a canister of dry towel, whose combination allows for providing a point of use wetted towel for use.

In at least one embodiment the lid 310 is comprised of a lid surface 319 with a lid surface interruption that defines a towel void 321 that further defines a void wall 323 between the lid surface 319 and the void top surface 322.

In at least one embodiment, the void top surface 322 is interrupted by a patterned interruption 324 that extends clear through the void top surface 322. Optionally, and depicted in FIGS. 1A through 1J the void top surface 322 is opposed by a void bottom surface 325 that hosts a rib 326 that extends from the void bottom surface 325.

In at least one embodiment the outer surface of the rib 326 and the reservoir side surface of the void wall 323 between the lid surface 319 and the void top surface 322 are continuous. Optionally, the rib 326 may taper as it extends away from the void top surface 322.

In at least one embodiment, the inner bowl 314 is comprised of an inner bowl surface and an outer bowl surface 329, where the inner bowl surface is interrupted by a bowl lip 330 that further defines an inner bowl wall 331 that extends between the inner bowl lip 330 and an inner bowl bottom 332 that is further interrupted by an inner bowl dam 335 between the inner bowl bottom 332 and a towel inlet 336, where the dam 335 follows a path that enables a sealing interference 337 between the dam 335 and the rib 326.

Optionally, and not shown in this embodiment, the rib 326 may be absent and the reservoir may be formed by an interference seal between the portion of the body defined by the void bottom surface 325 and the dam 335.

In at least one embodiment of the present invention, the disposable towel pre-wetting device 300 further includes a lid cap 311 connected by a flexible material connection 313 to the lid 310 providing a seal for the towel void 321. In this embodiment the lid cap 311 comprises a lid cap top surface 316 and a lid cap bottom surface 317 separated by a lid cap side 318. In at least one embodiment the lid surface 319 is configured to accept the lid cap 311 to form a seal. In at least one embodiment the void wall 323 is configured to accept the lid cap 311 to form a seal.

In one embodiment of the present invention, a towel pre-wetting device 300 is comprised of a lid 310 and an inner bowl 314 such that the lid 310 and the inner bowl 314 are configured to form a reservoir 315. The towel pre-wetting device 300 is intended to be affixed as a lid or replacement lid over a canister of dry towels, the combination of which enables the provision of a towel that is wet at the point-of-use. Alternatively, the towel pre-wetting device 300 may be affixed to a canister of pre-wet towels to provide supplementary wetting at the point-of-use.

In one embodiment the lid 310 is comprised of a lid surface 319 with a surface interruption that defines a towel void 321 that further defines a void wall 323 that spans (between) the lid surface 319 and the sealing rib 326 and further, the sealing interference 337. In one embodiment, a towel retainer 338 exists at or between the lid surface 319 and the towel void 321 and the sealing interference 337 between the lid 310 and the inner bowl 314.

In one embodiment, the towel retainer 338 void top surface 322 is interrupted by a patterned interruption 324 that extends clear through the towel retainer 338. Optionally, the towel retainer 338 void top surface 322 is opposed by a towel retainer 338 bottom surface 325 that hosts a sealing rib 326 that extends from the towel retainer 338 bottom surface 325. Optionally, the sealing function and implementing design elements may be distributed or exchanged between the lid 310 and the inner bowl 314.

In one embodiment the outer surface of the sealing rib 326 and the reservoir-side surface of the towel outlet tube 323 between the lid surface 319 and the towel retainer 338 void top surface 322 are continuous. Optionally, the sealing rib 326 may change in shape or narrow or taper as it extends towards or away from the towel retainer 338.

In one embodiment, the inner bowl 314 is comprised of an inner surface 331 and an outer surface 329, where the inner surface is interrupted by a lip 330 that further defines an inner wall 331 that extends between the lip 330 and an inner surface bottom 332. In one embodiment the inner surface bottom 332 is interrupted by a dam 335 that continues between the inner surface bottom 332 and the inner bowl 314 towel inlet 336. In one embodiment the dam 335 follows a path that enables a sealing interference 337 between the dam 335 and the rib 326. Optionally, the sealing function and implementing design elements may be distributed or exchanged between the lid 310 and the inner bowl 314. Optionally, and not shown in this embodiment, the rib 326 may be absent and the reservoir may be formed by an interference seal between the portion of the body defined by the void bottom surface 325 and the dam 335.

In one embodiment of the present invention, the disposable towel pre-wetting device 300 further includes a sealing cap 311 connected by a flexible material connection 313 to the lid 310 providing a seal for the towel void 321. In one embodiment the sealing cap 311 comprises a sealing cap top surface 316 and a sealing cap bottom surface 317 that are separated by a sealing cap side 318. In one embodiment the lid surface 319 is configured to accept the sealing cap 311 to form a seal, hermetic seal, or other connection. In one embodiment the towel outlet tube 323 is configured to accept the sealing cap 311 to further or exclusively form a seal.

In one embodiment, when a user pulls a disposable towel through the patterned interruption 324, a force is transmitted through the towel outlet tube 323 to the portion of the lid 310 that is defined by the lid surface 319, which deflects and temporarily opens the sealing interference 337 formed between the rib 326 and the dam 335 until the force is released and a unit of disposable towel is separated from the towel pre-wetting device 300.

In one embodiment, the towel retainer 338 is comprised of towel retaining levers 340 where the towel retaining levers extend from the body of the towel retainer 338. The distance between the contact location of the towel retaining levers 339 and the towel and the body of the towel retainer 338 and the towel serves to retain the towel and present the towel to the user in an accessible way.

In one embodiment, the towel pre-wetting device 300 is comprised of a lid 310, an inner bowl 314, and a towel holding portion where the circumference of the towel pre-wetting device 300 defined by the lid 310 and inner bowl 314 that enable the attachment to the towel holding portion where the circumference is separated, segmented, relieved, or otherwise configured to attach to the towel holding portion. Such segmentation of the circumference enables the coordinated assembly of the lid 310 and the inner bowl 314 of the towel pre-wetting device 300.

At least one element of the present invention is the on-demand point of use application of a fluid to a towel. In order to achieve this, a fluid holding portion only releases liquids to a towel holding portion on demand. In at least one embodiment, the fluid reservoir includes a bottom surface with an opening through which a towel may pass from a towel holding portion, a top surface with an opening through which a towel may pass after passing through the towel wetting portion, an outer wall extending up from an outer edge of the bottom surface to an outer edge of the top surface, a fill port through which a user may add fluid to the reservoir, and a capping mechanism for closing the fill port and preventing spilling or rapid evaporation of the fluid from the fluid reservoir. In some embodiments, the fill port is located in the top surface of the reservoir, while in other embodiments, the fill port is located in the outer wall of the fluid reservoir.

In at least one embodiment, the fluid reservoir further includes an interior wall extending down from an inner edge of the opening in the top surface. This interior wall would be concentric with the towel wetting portion and so dimensioned as to allow space for a spring mechanism to fit between the wall of the wetting portion and the interior wall. In order to maximize the volume of fluid able to be held in the fluid reservoir, the space between the wall of the towel wetting portion and the interior wall may be reduced as much as possible but still allow the spring mechanism to move freely in the space.

Figure 2A:
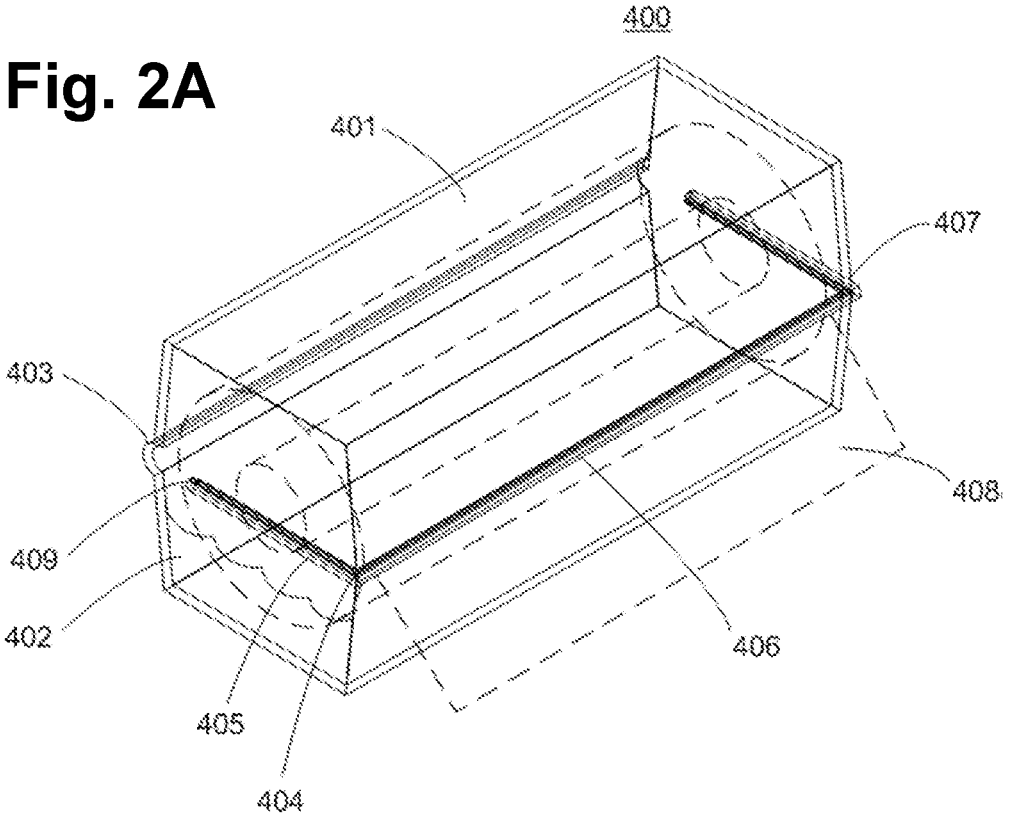
FIG. 2A is an oblique view of one embodiment of a towel pre-wetting device 400.
Figure 2B:
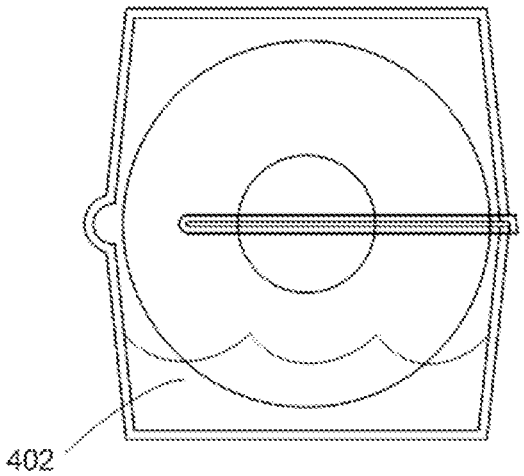
FIG. 2B is a side view of one embodiment of a towel pre-wetting device 400.
Figure 3A:
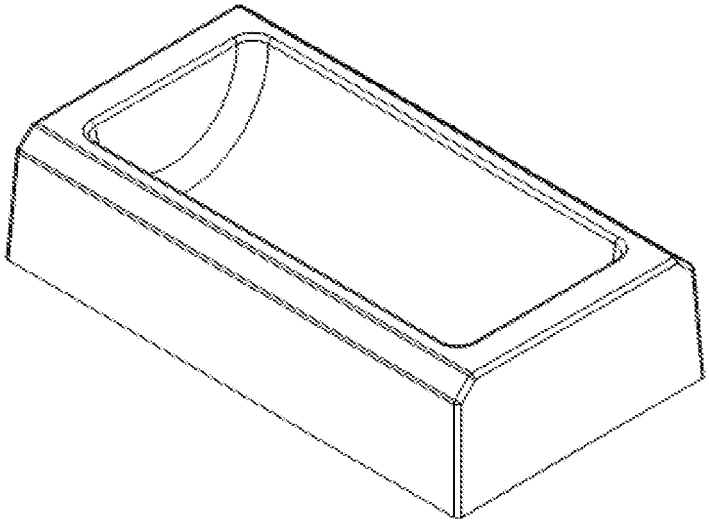
FIG. 3A is an oblique view of one embodiment of a pre-wetting device 500.
Figure 3B:
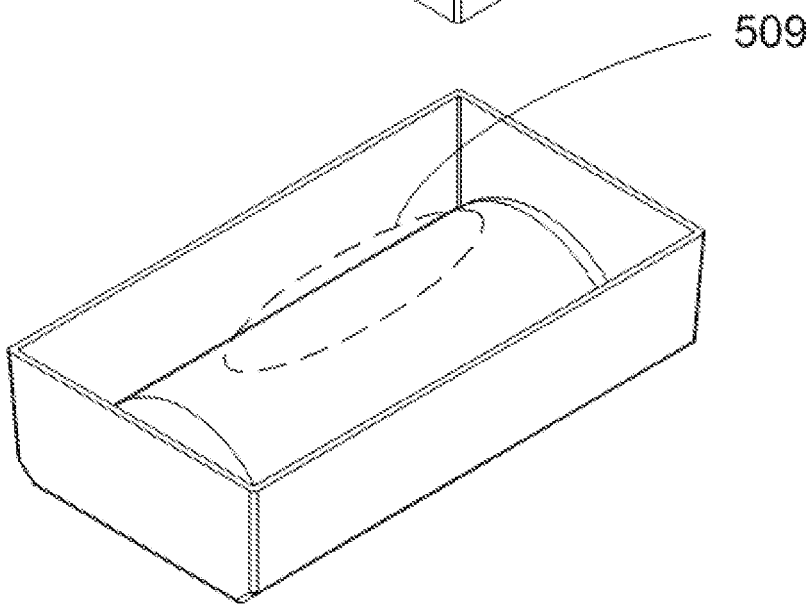
FIG. 3B is a lower oblique view of one component of one embodiment of a pre-wetting device 500.
Figure 3C:
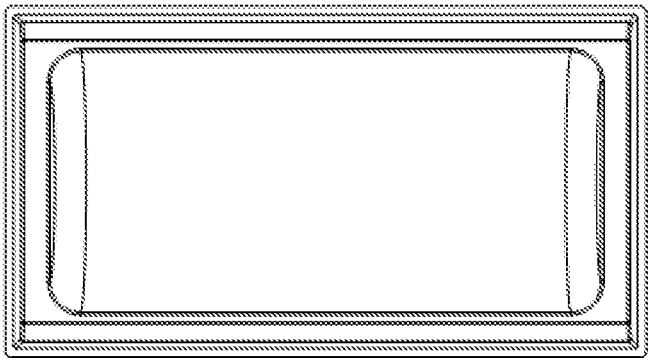
FIG. 3C is a top view of one component of one embodiment of a pre-wetting device 500.
Figure 3F:
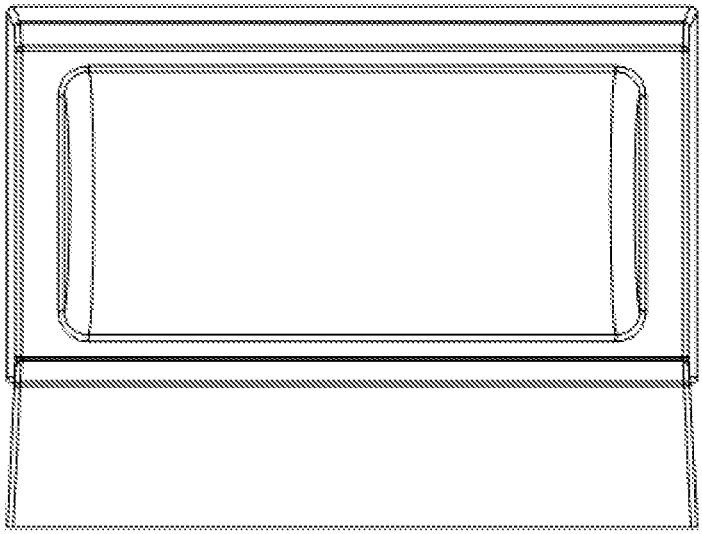
FIG. 3F is a front view of two components assembled into a pre-wetting device 500 shown in the open condition.
Figure 3G:
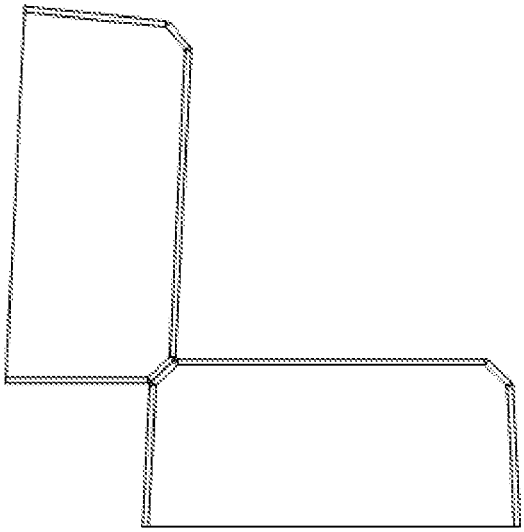
FIG. 3G is a side view of two components assembled into a pre-wetting device 500 shown in the open condition.
Figure 3H:
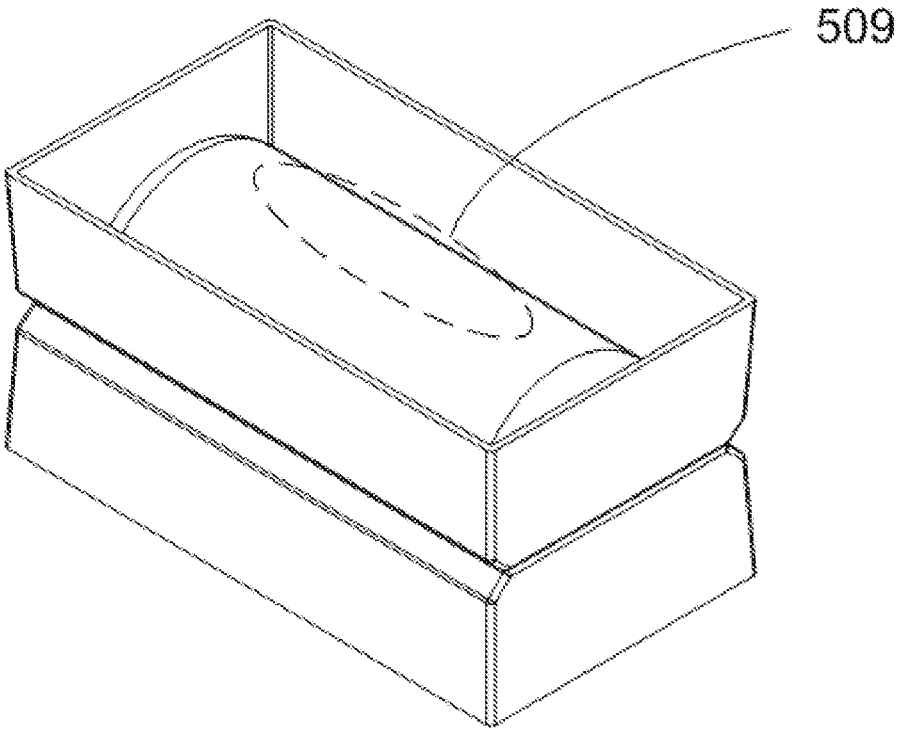
FIG. 3H is an oblique view of one closed embodiment of an inventive towel pre-wetting device 500.

Other embodiments of the present invention, including such embodiments illustrated in FIG. 2A and FIG. 2B provide a disposable towel pre-wetting device 400 is comprised of a top portion 401 and a bottom portion 402, where the top portion 401 and the bottom portion 402 are connected by a flexible material connection 403. In this embodiment the top portion 401 and the bottom portion 402 together define a lip seal 405, 407, a towel feed portion 406, and where the lip seal 405,407 are fully sealed along their respective lengths, and the and the towel feed portion 406 is partially sealed along its length affording the removal of, and separation of a disposable towel 408 there-through and generally therefrom, respectively. Optionally, in this embodiment the top portion 401 and the bottom portion 402 are able to be sealed along the lip seal 405,407 by a re-sealable or permanent interference fit or a re-sealable or permanent adhesive bond, or a permanent solvent or thermal bond.

Other embodiments of the present invention provide a towel pre-wetting device 400 that is comprised of a top portion 401 and a bottom portion 402, where the top portion 401 and the bottom portion 402 are connected by a flexible material connection 403. In this embodiment the top portion 401 and the bottom portion 402 together define complementary lip seals 405 and 407, and a towel feed portion 406 there through. The lip seals 405 and 407 may be fully or partially sealed along its respective length to provide an adaptable towel feed portion 406 to afford the removal of, and separation of a disposable towel 408 there through and generally therefrom. The distance between the flexible material connection 403 and the end of the lip seal 409 may be varied for manufacturing. For thermoforming, the distance between the flexible material connection 403 and the end of the lip seal 409 would be substantially zero as the device 400 would be made from a single piece of material, thermoformed, and folded. For molding out of silicone, the distance between the flexible material connection 403 and the end of the lip seal 409 would be substantially long to permit the device 400 to be loaded with a new roll of towels and first to be removed from the mold. Optionally, in this embodiment the top portion 401 and the bottom portion 402 are able to be sealed along the lip seal 405 and 407 by a resealable or permanent interference fit or a resealable or permanent adhesive bond, or a permanent solvent or thermal bond.

Another pre-wetting device 500 is presented in FIG. 3A to FIG. 3H, where the pre-wetting device 500 is comprised of a first component 501 and a second component 502, where optionally, the first component 501 and the second component 502 may be identical, similar, or dissimilar. In one embodiment, where the first component 501 and the second component 502 are identical or similar, the primary mating surfaces 503 and 504 are embedded with magnets or other attractive, capturing, or retaining design elements. In the same embodiment, where the first component 501 and the second component 502 are identical or similar, the secondary mating surfaces 505 and 506 are embedded with magnets or other attractive, capturing, or retaining design elements. Such attractive, capturing, or retaining design elements enable the device with stability in both open and closed conditions, where the open condition is shown in FIG. 3D through FIG. 3G and the closed condition is not shown. When in the closed condition, and when a towelette roll and antiseptic liquid have been inserted into the reservoir 507, towelettes can be unrolled and dispensed through the surfaces 503 and 504. Where magnets are used as attractive design elements, they increase the normal force applied to the towelette being dispensed and assist in tearing the towelette. Optionally, the open bottom surface 508 of one or both of the components may be sealed with a film with a frangible area through which gloves, masks, or other forms of personal protective equipment may be dispensed. Optionally, the open bottom surface 508 may be covered with a film that can be torn open or off to access gloves, masks, or other forms of personal protective equipment may be dispensed. Optionally, the film may be resealable or supplemented with additional materials including but not limited to cardboard.

In at least one embodiment, the reservoir is pre-filled prior to deployment with a pre-selected cleaning or sanitizing fluid for one or more particular use. In at least one embodiment, the reservoir is filled at the point of user using a user-selected fluid as needed. It should be appreciated that while the reservoir may be pre-filled, or filled at the point of use, that it is intended that the reservoir remains accessible, therefore fillable, at all times, as an end-user may elect.

Towel Wetting Portion

The towel wetting portion is a generally dry channel through which the towel is pulled to release fluid from the fluid holding portion to the towel wetting portion for a point of use application of a fluid to a towel. It is desired as part of this invention for the fluid to be released from the fluid holding portion only upon the drawing of a towel into, through, or near the towel wetting portion. In at least one embodiment the towel wetting portion lies between the fluid holding portion and the towel holding portion.

Adjustment

It is appreciated that a user may desire to have a towel of varying wetness for different uses, and it is intended as part of this invention to include a system that can accommodate for varying wetness ranges for towels travelling through the towel wetting portion. In at least one embodiment using the inner bowl includes a series of grooves through the dam that when aligned, allow for additional fluid to be applied from the reservoir to wet the towel when a towel is pulled through the lid.

In at least one embodiment the towel wetting lies between the inner bowl and the lid. In this embodiment, when a user pulls a disposable towel through the patterned interruption 324, a force is transmitted through the void wall 323 to the portion of the lid 310 that is defined by the lid surface 319, which deflects and temporarily opens the sealing interference 337 formed between the rib 326 and the dam 335 until the force is released and a unit of disposable towel is separated from the towel pre-wetting device 300.

Optionally, and not shown, the lid 310 and the inner bowl 314 may be configured with at least a first continuous or a first intermittent helical thread or at least a first helical protrusion 333 and complementary relief 334 such that the lid 310 may be rotated relative to the inner bowl 314 in order to increase or decrease the force necessary to remove a disposable towel from the device and in doing so, vary the rate of flow of the liquid from the reservoir onto and into the disposable towel to be withdrawn and separated from the device.

Towel Holding Portion

Certain embodiments include a towel holding portion for holding dry towels to be fed into the fluid wetting portion to be wetted at the point of use. The towel holding portion may be a container that holds rolls or stacks of dry or pre-moistened towels, and that has a bottom, walls, and a top opening through which towels may pass. In at least one embodiment, the top opening of the towel holding portion would have a fastening mechanism that corresponds to the fastening mechanism provided on the cap. In at least one embodiment, the cap and the towel holding portion may be reversibly fastened to one another via the fastening mechanism. In other embodiments, the cap and the towel holding portion may be permanently affixed to one another and the openings in the cap will enable towels to be inserted through the cap into the towel holding portion.

EXAMPLES

It is to be understood that while the invention has been described in conjunction with the detailed description thereof, the foregoing description is intended to illustrate and not limit the scope of the invention, which is defined by the scope of the appended claims. Other aspects, advantages, and modifications are within the scope of the following claims.

Example 1

A cap for point of use wetting of sanitizing towels is provided and illustrated in FIGS. 1A-1J.

Example 2

A cap for point of use wetting of sanitizing towels is provided and illustrated in FIGS. 2A-2B.

Example 3

A cap for point of use wetting of sanitizing towels is provided and illustrated in FIGS. 3A-3H.

Other Embodiments

While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration of the described embodiments in any way. Rather, the foregoing detailed description will provide those skilled in the art with a convenient road map for implementing the exemplary embodiment or exemplary embodiments.

The invention claimed is:

1. A cap for providing point-of-use wetting of a towel, the cap comprising:

a lid 310 having a lid surface 319 with a lid surface interruption that defines a towel void 321 having a void top surface 322 that further defines a void wall 323 between the lid surface 319 and the void top surface 322, wherein the void top surface 322 is opposed by a void bottom surface 325 that hosts a rib 326 that extends from the void bottom surface 325; and an inner bowl 314 disposed within the lid 310.

2. The cap of claim 1 wherein the outer surface of the rib 326 and the reservoir side surface of the void wall 323 between the lid surface 319 and the void top surface 322 are continuous.

3. The cap of claim 1 wherein the inner bowl 314 further comprises of an inner bowl surface and an outer bowl surface 329, where the inner bowl surface is interrupted by a bowl lip 330 that further defines an inner bowl wall 331 that extends between the inner bowl lip 330 and an inner bowl bottom 332 that is further interrupted by an inner bowl dam 335 between the inner bowl bottom 332 and a towel inlet 336, where the dam 335 follows a path that enables a sealing interference 337 between the dam 335 and the void bottom surface 325 or rib 326.

4. The cap of claim 1 wherein the lid 310 and the inner bowl 314 are configured with at least one helical thread 333 such that the lid 310 may be rotated relative to the inner bowl 314 in order to increase or decrease the force necessary to remove a disposable towel from the device and in doing so, vary the rate of flow of the liquid from the reservoir onto and into the disposable towel to be withdrawn and separated from the device.

5. The cap of claim 1 wherein said cap is adapted to interface with a towel holding portion.

6. The cap of claim 4 wherein said at least one helical thread 333 is continuous, intermittent, a protrusion, or combinations thereof, and wherein the cap further comprises at least one complementary relief 334 for receiving said at least one helical thread 333.

7. A cap for providing point-of-use wetting of a towel, the cap comprising:

a lid; and an inner bowl disposed within the lid having an inner bowl surface and an outer bowl surface 329, where the inner bowl surface is interrupted by a bowl lip 330 that further defines an inner bowl wall 331 that extends between the inner bowl lip 330 and an inner bowl bottom 332 that is further interrupted by an inner bowl dam 335 between the inner bowl bottom 332 and a towel inlet 336, where the dam 335 follows a path that enables a sealing interference 337 between the dam 335 and the void bottom surface 325 or rib 326.

8. The cap of claim 7 wherein said lid further comprises a lid surface 319 with a lid surface interruption that defines a towel outlet top 321 having a void top surface 322 that further defines a void wall 323 between the lid surface 319 and the void top surface 322.

9. The cap of claim 8 wherein the void top surface 322 is interrupted by a patterned interruption 324 that extends clear through the void top surface 322.

10. The cap of claim 8 wherein the void top surface 322 is opposed by a void bottom surface 325 that hosts a rib 326 that extends from the void bottom surface 325.

11. The cap of claim 10 wherein the outer surface of the rib 326 and the reservoir side surface of the void wall 323 between the lid surface 319 and the void top surface 322 are continuous.

12. The cap of claim 7 wherein the lid 310 and the inner bowl 314 are configured with at least one helical thread 333 such that the lid 310 may be rotated relative to the inner bowl 314 in order to increase or decrease the force necessary to remove a disposable towel from the device and in doing so, vary the rate of flow of the liquid from the reservoir onto and into the disposable towel to be withdrawn and separated from the device.

13. The cap of claim 12 wherein said at least one helical thread 333 is continuous, intermittent, a protrusion, or combinations thereof, and wherein the cap further comprises at least one complementary relief 334 for receiving said at least one helical thread 333.

14. The cap of claim 7 wherein said cap is adapted to interface with a towel holding portion.

15. A cap for providing point-of-use wetting of a towel, the cap comprising:

a lid 310; and an inner bowl 314 disposed within the lid;

wherein the lid 310 and the inner bowl 314 are configured with at least one helical thread 333 such that the lid 310 may be rotated relative to the inner bowl 314 in order to increase or decrease the force necessary to remove a disposable towel from the device and in doing so, vary the rate of flow of the liquid from the reservoir onto and into the disposable towel to be withdrawn and separated from the device.

16. The cap of claim 15 wherein said at least one helical thread 333 is continuous, intermittent, a protrusion, or combinations thereof, and wherein the cap further comprises at least one complementary relief 334 for receiving said at least one helical thread 333.

17. The cap of claim 15 wherein said lid further comprises a lid surface 319 with a lid surface interruption that defines a towel outlet top 321 having a void top surface 322 that further defines a void wall 323 between the lid surface 319 and the void top surface 322.

18. The cap of claim 17 wherein the void top surface 322 is interrupted by a patterned interruption 324 that extends clear through the void top surface 322.

19. The cap of claim 17 wherein the void top surface 322 is opposed by a void bottom surface 325 that hosts a rib 326 that extends from the void bottom surface 325.

20. The cap of claim 17 wherein the outer surface of the rib 326 and the reservoir side surface of the void wall 323 between the lid surface 319 and the void top surface 322 are continuous.

21. The cap of claim 15 wherein the inner bowl 314 further comprises of an inner bowl surface and an outer bowl surface 329, where the inner bowl surface is interrupted by a bowl lip 330 that further defines an inner bowl wall 331 that extends between the inner bowl lip 330 and an inner bowl bottom 332 that is further interrupted by an inner bowl dam 335 between the inner bowl bottom 332 and a towel inlet 336, where the dam 335 follows a path that enables a sealing interference 337 between the dam 335 and the void bottom surface 325 or rib 326.

22. The cap of claim 15 wherein said cap is adapted to interface with a towel holding portion.

* * * * *